US005617985A

United States Patent [19]

Baer

[11] Patent Number: 5,617,985

[45] Date of Patent: Apr. 8, 1997

[54] APPARATUS AND METHOD FOR SUPPORTING AND GUIDING STRIP MATERIAL THAT IS TO BE PROCESSED IN THE LOOP REGION

[75] Inventor: Manfred Baer, Mainleus, Germany

[73] Assignee: Karl Eugen Fischer Gmbh Maschinenfabrik, Burgkunstadt, Germany

[21] Appl. No.: 417,637

[22] Filed: Apr. 6, 1995

[30] Foreign Application Priority Data

Apr. 7, 1994 [DE] Germany ..... 44 11 936.4

[51] Int. Cl.[6] ..... B65H 20/24; B65H 23/192; G11B 15/56

[52] U.S. Cl. ..... 226/4; 226/44; 226/117; 226/118

[58] Field of Search ..... 226/4, 44, 45, 226/112, 115, 117, 118, 195; 242/535.4

[56] References Cited

U.S. PATENT DOCUMENTS 2,474,717 6/1949 Belcher ..... 226/4
2,649,867 8/1953 Powell ..... 226/115
3,465,936 9/1969 Wright ..... 226/44
4,356,946 11/1982 Gaskell ..... 226/117
4,832,243 5/1989 Usami ..... 226/115

*Primary Examiner*—Daniel P. Stodola
*Assistant Examiner*—Matthew A. Kaness
*Attorney, Agent, or Firm*—Jordan and Hamburg

[57] ABSTRACT

Apparatus for supporting strip material includes a discontinuous conveyor for discontinuously conveying a strip material and a continuous conveyor for continuously conveying the strip material. The strip material passes in a loop between the discontinuous conveyor and the continuous conveyor with the strip material loop varying in size as the discontinuous conveyor discontinuously conveys the strip material and the continuous conveyor continuously conveys the strip material. A conveyor belt mechanism disposed between the discontinuous conveyor and the continuous conveyor is operable to dispose a conveyor belt in a loop underlying the strip material loop. The conveyor belt mechanism is operable to drive the conveyor belt so as to variably change the size of the conveyor belt loop synchronously with the size of the strip material loop such that the looped strip material is continuously supported on the looped conveyor belt as the size of the strip material loop varies in accordance with the discontinuous conveying of the strip material by the discontinuous conveyor and the continuous conveying of the strip material by the continuous conveyor.

33 Claims, 3 Drawing Sheets

APPARATUS AND METHOD FOR SUPPORTING AND GUIDING STRIP MATERIAL THAT IS TO BE PROCESSED IN THE LOOP REGION

BACKGROUND OF THE INVENTION

The invention relates to an apparatus for supporting and guiding a strip material that is to be processed, particularly of nylon or steel cord strips, in the region of a loop of the strip material originating from the continuous or discontinuous transporting to or away from of the strip material by means of appropriate conveying equipment and changing its pendant position depending on the discontinuous transport to or away from:

Within the scope of manufacturing or processing such strip materials, a pendant loop is inevitably formed as a result of the different transport of the strip material to and away from. This pendant loop sags freely between the end of the supplying conveyor belt and the start of the discharging conveyor belt and changes its pendant position as a result of the different continuity of the transport. However, because it sags freely, there is stretching of the material in the loop region as a result of the weight of the material. This stretching results in a change of length, because of which, on the one hand, the material properties can change. On the other hand, errors can occur, for example, when processing strip parts already cut to a precisely determined length.

SUMMARY OF THE INVENTION

It is therefore an object of the invention to provide an apparatus, by means of which a change in the material parameters in the loop regions due to the free suspension of the loop can be prevented independently of the changing loop shape.

To accomplish this objective for an apparatus having the initially named features, a supporting conveyor belt is provided, which carries the strip material in the loop region at least in the region of the loop depression, is driven by at least one first driving mechanism so as to rotate continuously and form a loop. The speed of the supporting conveyor belt is coordinated by means of at least one second driving mechanism, controlling the speed of the conveyor belt locally, over a conveyor belt linear storage unit in such a way, that the conveyor belt loop changes synchronously with the material loop and the strip material loop is supported in every position on the supporting conveyor belt loop. Consequently, because it is supported on the supporting conveyor belt, the strip loop does not sag freely, so that weight-induced changes in parameters are precluded. Due to the inventive synchronization of forming the conveyor belt loop and the material loop, a continuous support is ensured so that, independently of the operation and the type of operation of the to and away from conveyor belts and the therefrom resulting loop formation, the increase or decrease in the two loops is always synchronized.

In order to achieve synchronization of the loop formation, it is necessary to synchronize the driving speed of the driving mechanisms of the supporting conveyor belt with the different conveying speeds of the strip material, for which reason, in a further development of the invention, provisions can be made so that the driving speed of the first driving mechanism is synchronized with the continuously operating conveying mechanism and, in a further development of the inventive concept, so that the driving speed of the second driving mechanism is synchronized with the conveying speed of the discontinuously operating conveying mechanism of the strip material. Due to this synchronization of speeds, the loop formation of the conveyor belt inevitably follows that of the strip material loop originating from the different conveying modes of the conveying mechanisms. Should variances, which result in a lifting off or in a corrugation of the strip material, nevertheless occur, then this can be countered owing to the fact that, over an inventively disposed sensing element for detecting permissible speed differences between the driving speeds of the first and optionally of the second driving mechanism on the one hand and the respective reference speed on the other and/or for detecting position differences between the strip material and the supporting conveyor belt, these differences are noted and the synchronization is adjusted to eliminate differences. Pursuant to the invention, this is accomplished most advisably owing to the fact that the sensing element is connected in a controlling manner with the first and/or the second driving mechanism for controlling the speed of the respective mechanisms as a function of the results observed, so that automatic regulation takes place.

So that the strip material can rest on the supporting conveyor belt over as large an area of loop as possible, provisions can be made in a further development of the invention so that the supporting conveyor belt is guided over at least two deflector rollers, which are disposed at a distance from one another in the region of the transfer positions of the strip material from and to the respective conveying mechanism. The loop runs between the, at least, two deflector rollers, the first and/or the second driving mechanism engaging one or both deflector rollers so as to drive them. Due to the fact that the deflector rollers are disposed close to the respective conveying mechanisms, support in almost the whole of the loop region is possible. Due to the inventive action of the driving mechanisms on these deflector rollers, reliable transportation of the conveyor belt in the immediate region of the loop is ensured. Pursuant to the invention, the first and second driving mechanisms can act on the deflector roller assigned to the continuously or discontinuously operating conveyor belt preferably over a belt or a chain, the synchronization then being accomplished over at least one sensing element, which detects the speed of the respective conveyor belt and is in controlling connection with the respective driving mechanism. Furthermore, the belt or the chain can be passed over the deflector roller and the driving mechanism as well as over a conveyor belt shaft, so that the synchronization is direct without sensing elements. Alternatively, the driving mechanisms can also act directly on the deflector roller or directly on the supporting conveyor belt. In order to be able to ensure an exact and continuous delivery of the strip in the latter case, which is realizable particularly with respect to the first driving mechanism, provisions can be made in a further development of the invention so that the first driving mechanism is disposed in the region below the deflector roller, so that the supporting conveyor belt is taken off essentially vertically between the deflector roller and the driving mechanism disposed below the roller.

Any positional differences between the individual belts and strips are equalized, as already described, by appropriately regulating the driving speeds of the different driving mechanisms of the supporting conveyor belt, which is then, depending on the difference, decelerated or accelerated and then, as it were, pulled through under the strip material, until the strip lies on the belt once again. So that this pulling through becomes possible, the first and/or second driving mechanism can be provided, pursuant to the invention, with braking and coupling mechanisms for braking and/or uncoupling the driving mechanism out of the respective driving connection with the respective deflector roller, so that, in case of need, the driving mechanisms and the deflector rollers can be driven or braked independently of one another. However, this is necessary only if the respective driving mechanism, which can be constructed as a servo drive pursuant to the invention, is coupled with the respective deflector roller.

In order that the conveyor belt is always under some tension in the loop region, so that, on the one hand, the legs of the loop run essentially in a straight line and the strip material lies on it in a non-arched form, and, on the other, the conveyor belt is conveyed against the force of a weight, which is of advantage for transporting the supporting conveyor belt accurately particularly when compensating for errors, provisions can be made in a further refinement of the invention so that, in the loop region of the supporting conveyor belt, a roller cage, which changes its position with that of the supporting conveyor belt, is disposed, which acts on this supporting conveyor belt, guides it and is guided over at least one guide roller, acting on the upper side of the conveyor belt in the region of the loop depression at a distance from the strip material, pendantly at the supporting conveyor belt. Due to its rolling suspension on the supporting conveyor belt, this roller cage thus always hangs in the loop depression, so that the legs of the loop are constantly under a slight tension due to the weight of the roller cage.

In order to prevent that the strip material, then hanging freely a short distance in the loop depression region in the case of such a roller cage arrangement, consequently forming a small, once again unguided loop, which then in turn can lead to changes in the material parameters, further provisions can be made within the scope of the invention to dispose at the roller cage in the region above the guide roller at least one supporting roller supporting the free strip material, so that the strip material is securely supported also in this region and damage to the material need not be feared. In order to be able to guide the strip material in this region of the loop, if possible, at every position and on a steady path, several bearing rollers, disposed along an arc of a circle forming a depression, can be provided pursuant to the invention. In a further development, the supporting conveyor belt is guided before and after the guide roller about the in each case outer bearing roller functioning as deflector roller, so that, on the basis of this conveyor belt guidance, a constant, "harmonic" transfer of the strip material from the conveyor belt to the bearing rollers is possible. At the same time, it has proven to be particularly appropriate, if, as can furthermore be provided pursuant to the invention, at least one sensing element, preferably a fiber-optical light guide, which is in controlling connection with the first and/or second driving mechanism, is disposed in the region of the bearing roller for determining the position of the strip material, so that possible positional differences can also be detected and compensated for precisely in this region.

In order to prevent the supporting conveyor belt, which is conveyed into the strip material storage unit and placed there in layers in accordance with the previous embodiment, being either creased as a result of its own weight and the several layers or twisted, provisions can be made in a further development of the invention that a further guide roller, guiding the conveyor belt pulled out of the conveyor belt storage unit, is disposed on the underside of the roller cage. The linear storage unit is largely "emptied" in this manner, since the conveyor belt, due to the increased deflection, which changes equally as the roller cage rises and falls, is guided over a significantly longer distance. Furthermore, an inlet funnel, assigned to the conveyor belt linear storage unit for guiding the conveyor belt transported in the linear storage unit, can be provided pursuant to the invention, so that this conveyor belt enters in a coordinated manner and optionally is placed on top of one another. This is of particular advantage also for a frictionless take off and guidance of the conveyor belt from the linear storage unit.

In order to prevent a horizontal or oscillating motion of the roller cage when the loop shape is changed or corrected, this roller cage can be guided vertically movably pursuant to the invention by way of preferably two laterally disposed vertical rails, so that only a vertical, but not a horizontal motion is possible. To facilitate the guidance, track rollers, guided on the vertical rails, can be disposed pursuant to the invention on the roller cage. However, a peg guidance or wave guidance in a running groove at the vertical rails is also conceivable.

So that the supporting conveyor belt is not transported in an uncontrolled manner within as well as without the loop region, at least one further guiding mechanism, particularly rollers, for guiding the supporting conveyor belt, can be provided within and/or without the loop region in a further development of the invention.

As a result of the changing length of the supporting conveyor belt loop, a belt storage unit is required, from which, when the loop is lengthened, conveyor belt can be produced or in which, when the loop is shortened, the conveyor belt can be deposited. The storage unit can be constructed in such a manner, that it is merely a region, in which the conveyor belt is deposited with folding or layering or pulled off appropriately.

The inventive method of controlling the loop formation of a supporting conveyor belt, which is driven by means of driving mechanisms and, in the region of the loop, supports and guides a loop-forming strip material, particularly nylon or steel-cord strips, which is transported over continuously or discontinuously operating conveyor belts transporting to and away from, provides pursuant to the invention that the supporting conveyor belt is driven over the driving mechanisms synchronized with the continuously or discontinuously operating conveyor in such a manner, that the loop formation takes place synchronously with the loop formation of the strip material, so that this strip material is supported in every position on the supporting conveyor belt loop. In a further development of the inventive method, provisions can furthermore be made so that the driving mechanisms are compensatorily controlled over sensing elements, which detect synchronization differences and/or positional differences between the strip material and the conveyor belt.

Further advantages, distinguishing features and details of the invention arise out of the examples described in the following and out of the accompanying drawings.

DESCRIPTION OF THE PREFERRED EMBODIMENTS

Figure 1:
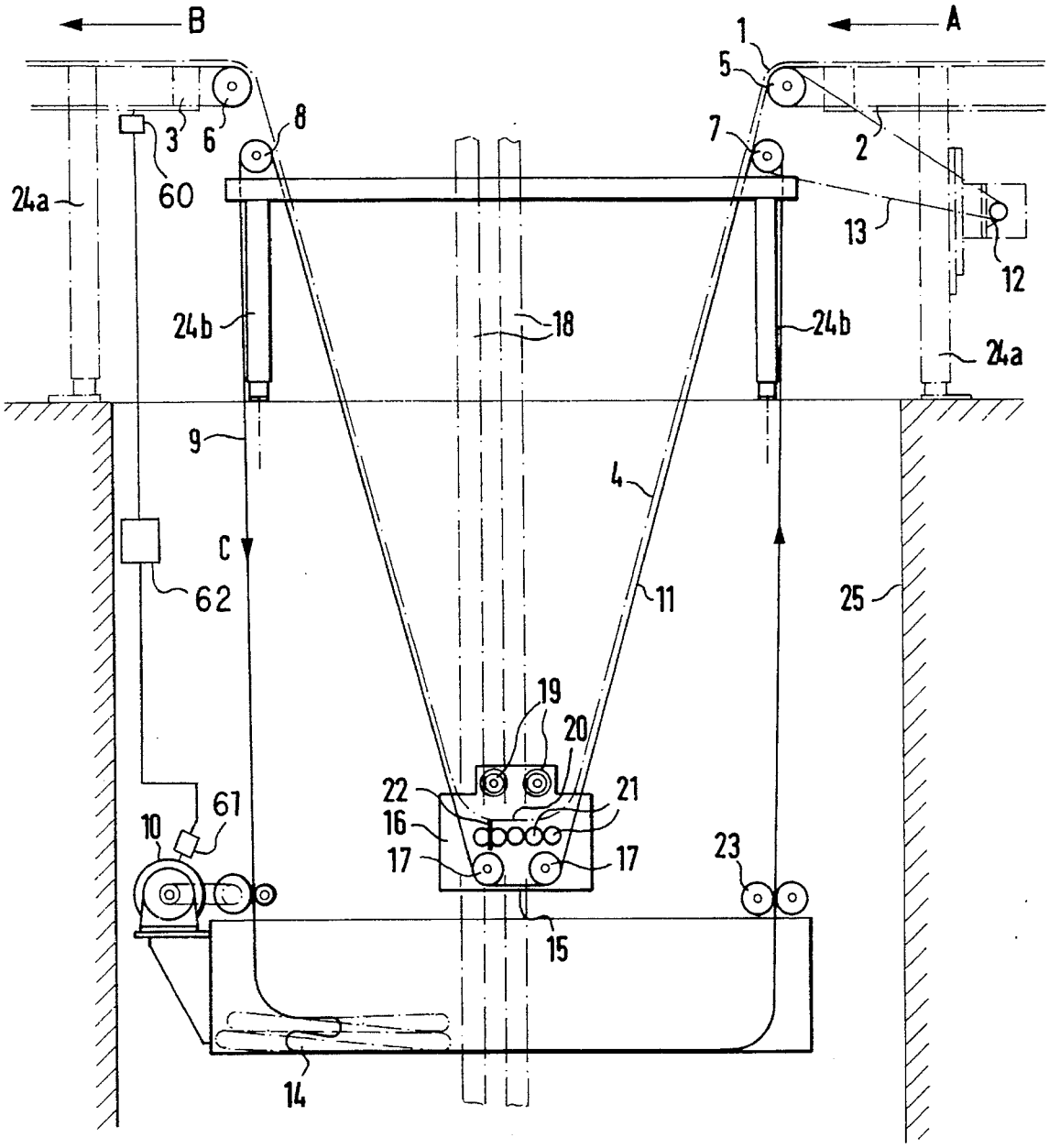
FIG. 1 shows an apparatus for supporting strip material, which is supplied discontinuously and carried away continuously.

FIG. 1 shows an apparatus for controlling loops, which is used, in the form shown, within the scope of a discontinuous supplying and a continuous transporting away of the strip material. One such use may be appropriate when this apparatus is connected, for example, to the inlet side of a strip cutting apparatus, in which the strip material comes to rest for the cutting operation, and to the outlet side of a winding-up apparatus. The transporting of the strip material 1, which is indicated by the line of dots and dashes, is accomplished by a conveyor belt 2 operating discontinuously in the direction of arrow A and a conveyor belt 3 operating continuously in the direction of arrow B. Conveyor belts 2 and 3 are at a distance from one another and a conveyor belt operable means for driving a supporting conveyor belt 9 is disposed between the conveyor belts 2 and 3 so that the loop 4 of strip material can form in the region between the belts. The conveyor belt operable means includes deflector roller 7, 8 along with first drive means 10 and second drive means 12 and other components as will be further described hereinafter. The deflector roller 7 or 8 is assigned to the transporting rollers 5, which is furthest to the rear and 6, which is closest to the front respectively of the conveyor belts 2, 3. A supporting conveyor belt 9, which is driven over the first driving mechanism 10 continuously in the direction of arrow C, is guided about the deflector rollers 7 and 8. In the region between the deflector rollers 7, 8, the supporting conveyor belt 9 also forms a loop 11, on which the loop 4 of the strip material 1 is supported. To ensure that the loop 11 of the supporting conveyor belt 9 is formed synchronously with the loop 4 of the strip material, so that the latter is supported at all times on the loop 11 of the conveyor belt 9, the second driving mechanism 12 is assigned to the deflector roller 7, which is assigned to the discontinuously operating transporting roller 5. In the embodiment shown, this second driving mechanism 12 acts over a belt or a chain 13 on the conveyor belt roller 5 as well as on the deflector roller 7 and synchronizes these with respect to their speed and mode of operation. Since the loop formation of the strip material 1 is brought about by the discontinuous transporting by means of the conveyor belt 2 and the shape of the loop changes alternately due to the alternating stopping and starting and since the subsequent transporting at a speed higher than that of the continuous take-off, the shape of the loop 11 of the supporting conveyor belt changes synchronously with that of the loop 4 of the strip material due to this synchronization of the driving mechanisms of the conveyor belt 2 and of the second driving mechanism 12 and, with that, of the deflector roller 7. Instead of the synchronization shown, which is realized over the chain, the second driving mechanism 12 can also act directly on the deflector roller 7. In this case, the synchronization is then effected electronically over the sensing element detecting the transporting speed of the belt 2.

Aside from the synchronization of the speeds of the conveyor belt 2 and of the second driving mechanism 12, the driving speed of the continuously operating driving mechanism 10 must also be synchronized with that of the continuously discharging conveyor belt 3 in order to ensure the synchronism of the loop formation. This is accomplished electronically in the example shown by the sensing elements determining the speed of the conveyor belt 3, as a result of the distance from the driving mechanism 10 to the transfer region of the strip material and, with that, to the rollers 6 and 8. As shown in FIG. 1, a detecting element 60 is provided for detecting the speed of the conveyor belt 3 and another detecting element 61 is provided for detecting the speed of the first driving mechanism 10. A synchronizing means 62 connected to the detecting elements 60 and 61 synchronizes the speed between the conveyor belt 3 and the first driving mechanism 10. Likewise, however, the first driving mechanism 10, as described with respect to the second driving mechanism 12, could be synchronized by means of a chain or the like if positioned appropriately. However, in the example shown, the driving mechanism 10 is disposed essentially vertically below the deflector roller 8, as a result of which the direction, in which the supporting conveyor belt 9 is taken off, is vertical. The conveyor belt 9 is transported from the first driving mechanism 10 directly into the supporting conveyor belt storage unit 14 and placed in layers there. Then, when the second driving mechanism 12 is operating, that is, when the strip material 1, after having come to a stop, is transported once again, the supporting conveyor belt, required to enlarge the supporting conveyor belt loop 11, is transported out of this conveyor belt linear storage unit 14, so that the storage volume decreases as a result of the higher take-off speed over the driving mechanism 12. When the supplying of strip material is halted, the situation is reversed and the storage unit fills up once again.

As can furthermore be inferred from FIG. 1, a roller cage 16 is disposed in the region of the depression 15 of the supporting conveyor belt loop 11. This serves to tighten the supporting conveyor belt loop 11, so that the latter runs linearly and under tension in the regions adjoining the depression 15 and so that the strip material loop 4 can lie upon it linearly and without curvature. Moreover, a reliable transport of the conveyor belt 9 from the loop region is assured by the pre-tension. In the example shown, the roller cage 16 is pendantly supported over two guide rollers 17, which act on the upper side of the conveyor belt in the depression region 15. The supporting conveyor belt is passed around the roller 17, so that the roller cage 16 retains its position during the transporting of the belt. So that there is no horizontal pivoting motion of the roller cage 16 during the conveying of the belt when the loop shape is changing as well as when it is not changing, the roller cage 16 is movably supported over track rollers 19, disposed on the roller cage 16, on vertical rails 18, which are preferably disposed on either side, so that the roller cage 16 can be shifted only vertically. So that the strip material 1, which as a result of the arrangement of the roller cage 16, is at a distance from the supporting conveyor belt in the depression region 20, is not freely suspended in the depression region 20, which, in turn, can lead to changes in the material parameters, several bearing rollers 21, supporting the strip material 1 in the depression region, are disposed at the roller cage 16, so that the strip material is securely supported also in this region. In order to detect any lifting off of the strip material in the depression region 20, which lifting off is based on resulting permissible speed differences between the transporting speed of the conveyor belt 3 and the driving speed of the first driving mechanism 10, a sensing element 22 in the form of a fiber-optical light guide is disposed in the region of the bearing rollers 21. This fiber-optical light guide is in controlling connection with the first driving mechanism 10 and regulates the speed of the latter when positional differences have been detected, so that the supporting conveyor belt 9 is transported more rapidly and pulled under the strip material 1 in the loop region, as a result of which the roller cage 16 is raised slightly. This more rapid transporting takes place until the strip material depression 20 once again lies on the bearer rollers 21, which is detected by the sensing element 22. Subsequently, the conveyor belt 3 and the driving mechanism 10 once again operate synchronously.

Figure 2A:
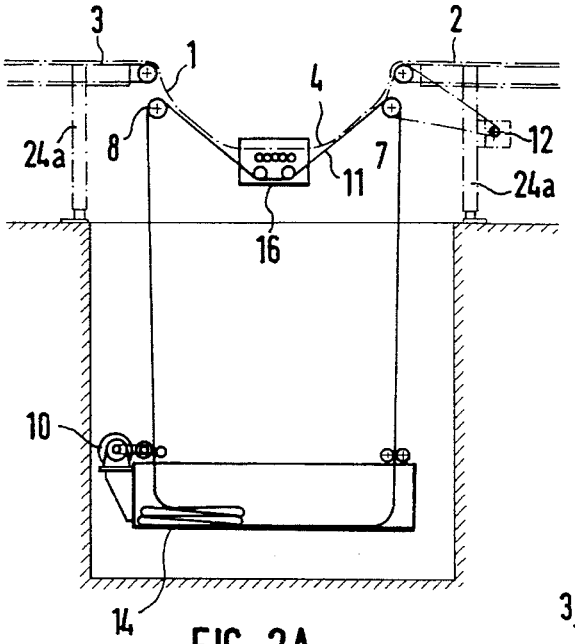
FIGS. 2A, 2B, 2C show the apparatus of FIG. 1 in diagrammatic form in different loop positions.
Figure 2B:
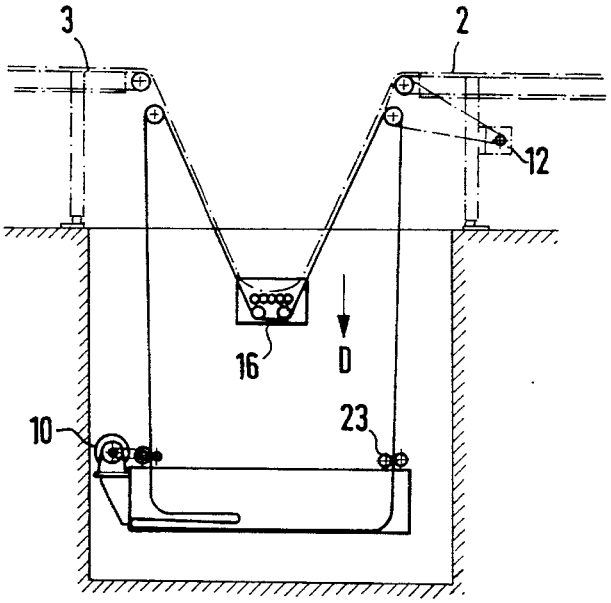
Figure 2C:
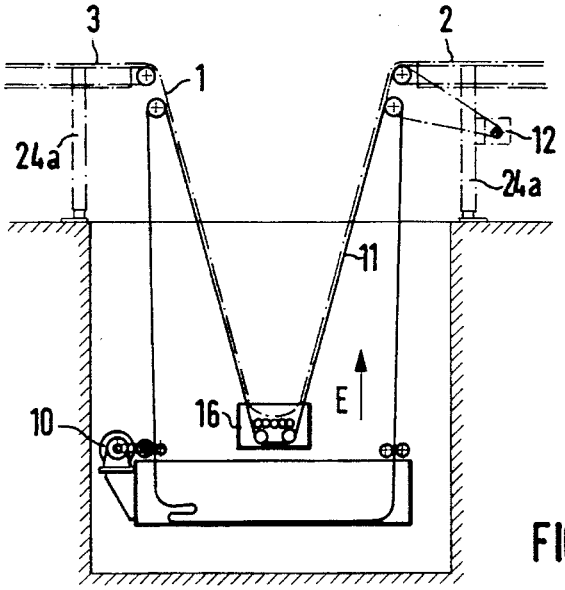

The mode of operation of the apparatus becomes clear from FIGS. 2A to C. FIG. 2A shows the state, when the discontinuous conveyor belt 2 has been stopped for some time and the continuous conveyor belt 3 has transported away the strip material 1 continuously. Since the second driving mechanism 12 is also stopped because of the stoppage of the conveyor belt 2, the deflector roller 7 is also not moved. At the same time, however, the supporting conveyor belt 9 is drawn off by means of the first driving mechanism 10 continuously about the roller 8 into the first storage unit 14. For this reason, the loop 11 moves continuously from the lowest position, shown in FIG. 2C, synchronously with the loop 4 of the strip material, which acts synchronously due to the removal by means of the conveyor belt 3.

If the transport of material by way of the conveyor belt 2 commences once again at a particular time, both loops 4 and 11 change as a result of the synchronized, coupled transporting speeds of the conveyor material 2 and the second driving mechanism 12, since the transporting and driving speeds are larger than the continuous take-off speed of the belt 3 or of the driving mechanism 10. The lengths of the loops increase, the roller cage sinks vertically downward in the direction of arrow D (FIG. 2B), the storage unit 14 is emptied gradually, a guiding mechanism 23, in the form of braked rollers, being disposed for the reliable guidance of the conveyor belt 9, which is drawn off from the storage unit 14. The loop enlarges until the conveyor belt 2 and, with that, the driving mechanism 12 are stopped. At this time, the loop has a maximum length, as can be inferred from FIG. 2C. Due to the continuous removal or take-off by way of the conveyor belt 3 and the driving mechanism 10, the loop length is shortened once again and the roller cage is raised in the direction of arrow E. If the roller cage approaches the position, shown in FIG. 2A once again after some time, the course of events, just described, is repeated once more.

Since appreciable loop lengths may result depending on the transporting speeds and the duration of the stoppage of the transporting to, the loop, shown in the embodiment, is formed in a structural pit 25. As a result of such an arrangement, the dimensions of the supports 24*a*, carrying the conveyor belts, and of the supports 24*b*, carrying the deflector rollers 7 and 8, can be dimensioned correspondingly small.

Figure 3:
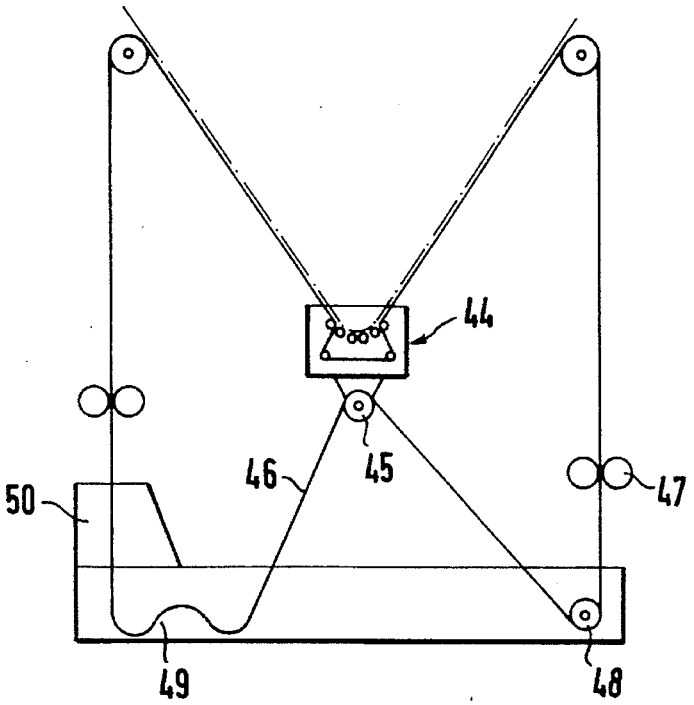
FIG. 3 shows a further embodiment of the roller cage, at the underside of which a guide roller, guiding the conveyor belt, is disposed.
Figure 4:
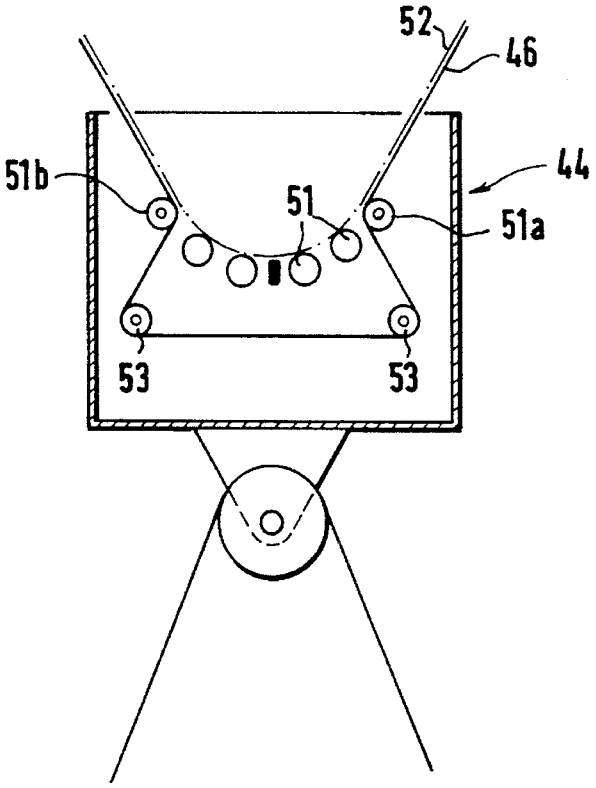
FIG. 4 shows an enlarged view of the roller cage of FIG. 3, partially in section.

FIGS. 3 and 4 show a further embodiment of the roller cage, which serves for the improvement of the guidance of the strip material in the loop region and for the simpler and belt-conserving design of the linear storage unit. For example, a further guide roller 45, over which the supporting conveyor belt 46 is guided, is disposed below the roller cage 44, which is shown in FIG. 3 and illustrated in greater detail in FIG. 4. Furthermore, a further deflector roller 48 for the conveyor belt 46 is provided below the guiding mechanism 47, which comprises braked rollers. Since the guiding roller 45 is raised or lowered synchronously with the roller cage 44, the path of the conveyor belt 46 between the linear storage unit 49 and the deflector roller 48 also changes therewith. This causes the conveyor belt 46 to be drawn off and tightened quasi continuously from the linear storage unit 49 by lengthening or shortening the path to the deflector roller 48. As a result, damage in the linear storage unit 49 due to the weight or twisting of the belt 46 is avoided. Furthermore, FIG. 3 shows the inlet funnel 50, which is assigned to the linear storage unit 49 and serves for the coordinated transporting-in of the conveyor belt 46.

The concrete construction of the roller cage 44 is shown in FIG. 4. The roller cage 44 has several bearing rollers 51, which are disposed along an arc of a circle and thus from a continuous depression. In order to ensure a constant transfer of strip material 52 from the conveyor belt 46 to the bearing rollers 51, the conveyor belt 46 initially is passed around the bearing roller 51*a*, which serves, as it were, as a deflector roller, after which the conveyor belt 46 is passed underneath the bearing rollers 51 and two guide rollers 53. Subsequently, before it leaves the roller cage 44, it passes around the bearing roller 51*b*. In this way, the strip material 52 can be transferred steadily and continuously from the conveyor belt 46 to the bearing rollers 51 without hanging down freely anywhere without being guided.

I claim:

1. Apparatus for supporting strip material comprising:

discontinuous conveyor means for discontinuously conveying said strip material;

continuous conveyor means for continuously conveying said strip material, said strip material passing in a loop between said discontinuous conveyor means and said continuous conveyor means with said strip material loop varying in size as said discontinuous conveyor means discontinuously conveys said strip material and said continuous conveyor means continuously conveys said strip material;

a supporting conveyor belt;

conveyor belt operable means operable to dispose said conveyor belt in a loop underlying said strip material loop;

said conveyor belt operable means being operable to drive said conveyor belt so as to variably change the size of said conveyor belt loop synchronously with the size of said strip material loop such that said looped strip material is continuously supported on said looped conveyor belt as the size of said strip material loop varies in accordance with the discontinuous conveying of said strip material by said discontinuous conveyor means and the continuous conveying of said strip material by said continuous conveying means.

2. Apparatus according to claim 1 wherein said conveyor belt is an endless conveyor belt travelling over an endless path, said conveyor belt operable means including a temporary storage means in which a portion of said conveyor belt is temporarily stored tension free, said conveyor belt operable means comprising a first belt drive mechanism for driving said conveyor belt from said conveyor belt loop to said storage means, said conveyor belt operable means comprising a second belt drive mechanism for driving said conveyor belt from said storage means to said conveyor belt loop.

3. Apparatus according to claim 2 wherein said first belt drive mechanism continuously drives said conveyor belt.

4. Apparatus according to claim 2 wherein said conveyor belt operable means comprises synchronizing means between said continuous conveyor means and said first belt drive mechanism for synchronizing the speed between said continuous conveyor means and said first belt drive mechanism.

5. Apparatus according to claim 2 wherein said conveyor belt drive means comprises synchronizing means between said discontinuous conveyor means and said second belt drive mechanism for synchronizing the speed between said discontinuous conveyor means and said second belt drive mechanism.

6. Apparatus according to claim 2 wherein said conveyor belt operable means comprises first detecting means for detecting the speed of said first belt drive mechanism and Second detecting means for detecting the speed of said continuous conveyor means.

7. Apparatus according to claim 2 wherein said conveyor belt operable means comprises a sensing element for sensing a change in the relative position between said conveyor belt loop and said strip material loop and using said sensed change for controlling said conveyor belt operable means.

8. Apparatus according to claim 2 wherein said conveyor belt operable means comprises synchronizing means for synchronizing the speed of said discontinuous conveyor means and said second belt drive mechanism.

9. Apparatus according to claim 2 wherein said conveyor belt operating means comprises synchronizing means for synchronizing the speed of said continuous conveyor means and said first belt drive mechanism, said synchronizing means including detecting means for detecting the speed of said continuous conveyor means.

10. Apparatus according to claim 2 wherein said first belt drive mechanism includes a pair of drive rollers in direct contact with said conveyor belt.

11. Apparatus according to claim 2 wherein conveyor belt operable means comprises braking means for braking said conveyor belt.

12. Apparatus according to claim 2 wherein at least one of said first and second belt drive mechanisms comprises a coupling and uncoupling mechanism.

13. Apparatus according to claim 2 wherein at least one of said first and second belt drive mechanisms comprises a servo drive.

14. Apparatus according to claim 2 wherein said conveyor belt operable means comprises a first deflection roller juxtaposed to said discontinuous conveyor means and a second deflection roller spaced from said first deflection roller and juxtaposed to said continuous conveyor means, said conveyor belt passing over said first and second deflection rollers and supporting said conveyor loop, said second belt drive mechanism driving said first deflection roller.

15. Apparatus according to claim 14 wherein said second belt drive mechanism includes a drive shaft, said discontinuous conveyor means including a conveyor roller, said drive shaft driving said conveyor roller and said first deflection roller.

16. Apparatus according to claim 14 wherein said second deflection roller generally overlies said first belt drive mechanism such that a vertical section of said conveyor belt extends between said second deflection roller and said first belt drive mechanism, said first belt drive mechanism pulling said conveyor belt over said second deflection roller and vertically straight down to said first belt drive mechanism.

17. Apparatus according to claim 2 wherein said first belt drive mechanism feeds said conveyor belt into said conveyor belt storage means.

18. Apparatus according to claim 1 wherein said strip material has a lower loop section which rises and lowers as the size of said conveyor belt is varied by said conveyor belt operable means, said conveyor belt having a lower loop section which rises and lowers as the size of said conveyor belt is varied by said conveyor belt operable means and further comprising a roller cage disposed on said lower loop section of said conveyor belt and which also rises and lowers with said lower loop section of said conveyor belt as the size of said conveyor belt loop varies, said roller cage including guide rollers which engages said conveyor belt.

19. Apparatus according to claim 18 wherein said lower loop section of said strip material is spaced from said lower loop section of said conveyor belt.

20. Apparatus according to claim 19 wherein said roller cage includes a support structure and detecting means for detecting the position of said lower loop section of said strip material relative to said support structure and synchronizing means operable to utilize said detected position to control said conveyor belt operable means so that the latter controls the position of said lower loop section of said strip material relative to said support structure.

21. Apparatus according to claim 19 wherein said roller cage includes support means underlying said lower loop section of said strip material to support said lower loop section of said strip material.

22. Apparatus according to claim 21 wherein said support means comprises support rollers.

23. Apparatus according to claim 22 wherein said support rollers are arranged along an arcuate path.

24. Apparatus according to claim 22 wherein said guide roller means comprises a pair of guide rollers which deflect said conveyor belt clear of said support rollers.

25. Apparatus according to claim 18 further comprising a support structure juxtaposed to said strip material loop and juxtaposed to said belt conveyor loop, and guide means on said roller cage and on said support structure for guiding said roller cage along a linear vertical path as said strip material loop and said conveyor belt loop vary in size.

26. Apparatus according to claim 25 wherein said guide means on said support structure comprises vertical guide rails and said guide means on said roller cage comprises track rollers.

27. Apparatus according to claim 18 wherein said guide roller means on said roller cage means is designated a first guide roller means, said conveyor belt operable means further comprising second guide roller means, said second guide roller means including braking means for braking said conveyor belt.

28. Apparatus according to claim 27 wherein said conveyor belt passes from said conveyor belt storage means to said braking means.

29. A method of controlling a strip material comprising the steps of:

continuously conveying one section of said strip material;

discontinuously conveying another section of said strip material;

forming a loop in a further section of said strip material between said one and said other sections of said strip material;

effecting a change in the size of said strip material loop as said one section of strip material is continuously conveyed and said other section of strip material is discontinuously conveyed;

forming a conveyor belt into a conveyor belt loop and disposing said conveyor belt loop in a position to underlie said strip material loop; and changing the size of said conveyor belt loop in synchronism with the change in size of said strip material loop such that said conveyor belt loop continuously underlies and supports said strip material loop.

30. A method according to claim 29 further comprising detecting relative change in size between said strip material loop and said belt conveyor loop and utilizing said detected relative change in size to monitor said step of changing the size of said conveyor belt loop in synchronism with the change in size of said strip material loop such that said conveyor belt loop continuously underlies and supports said strip material loop.

31. A method according to claim 29 wherein said strip material loop has a lower portion and said conveyor belt loop has a lower portion, and further comprising:

raising and lowering said lower portion of said conveyor belt loop as said strip material loop changes size; and disposing a roller cage structure on said lower portion of said conveyor belt such that said roller cage structure rolls on said conveyor belt and rises and lowers with said raising and lowering of said lower portion of said conveyor belt loop.

32. A method according to claim 31 further comprising separating said lower portion of said conveyor belt loop from said lower portion of said strip material loop and supporting said lower portion of said strip material loop on in said roller cage structure.

33. A method according to claim 31 further comprising guiding said roller cage structure for movement along a vertical linear path during said raising and lowering of said lower portion of said conveyor belt loop.

* * * * *